US009877544B2

(12) United States Patent
Yamamoto

(10) Patent No.: US 9,877,544 B2
(45) Date of Patent: Jan. 30, 2018

(54) SHOE INSOLE

(71) Applicant: PRESS CONTROL Co., Ltd., Ikoma-shi, Nara (JP)

(72) Inventor: Shuji Yamamoto, Ikoma (JP)

(73) Assignee: PRESS CONTROL Co., Ltd., Ikoma-shi, Nara (JP)

( * ) Notice: Subject to any disclaimer, the term of this patent is extended or adjusted under 35 U.S.C. 154(b) by 0 days.

(21) Appl. No.: 15/023,953

(22) PCT Filed: Feb. 12, 2016

(86) PCT No.: PCT/JP2016/054199
§ 371 (c)(1),
(2) Date: Mar. 22, 2016

(87) PCT Pub. No.: WO2016/129696
PCT Pub. Date: Aug. 18, 2016

(65) Prior Publication Data

US 2016/0353839 A1 Dec. 8, 2016

(30) Foreign Application Priority Data

Feb. 12, 2015 (JP) ..... 2015-025881

(51) Int. Cl.
*A43B 17/02* (2006.01)
*A43B 17/14* (2006.01)
*A43B 7/14* (2006.01)

(52) U.S. Cl.
CPC ..... *A43B 17/02* (2013.01); *A43B 7/141* (2013.01); *A43B 7/144* (2013.01); *A43B 7/148* (2013.01); *A43B 7/1445* (2013.01); *A43B 17/14* (2013.01)

(58) Field of Classification Search
CPC ..... A43B 7/14; A43B 7/144; A43B 7/148; A43B 7/1405; A43B 7/1415; A43B 7/1455; A43B 7/1475; A43B 7/141; A43B 7/1485
(Continued)

(56) References Cited

U.S. PATENT DOCUMENTS 4,232,457 A * 11/1980 Mosher ..... A43B 7/141 36/154
4,597,196 A * 7/1986 Brown ..... A43B 1/0072 36/140
(Continued)

FOREIGN PATENT DOCUMENTS

JP 3944536 B 7/2007
JP 2010063845 A 3/2010
JP 5070445 B 11/2012

OTHER PUBLICATIONS

Japanese Patent Office, Office Action Issued in Japanese Patent Application No. 2015-025881, dated Sep. 11, 2015, 4 pages.
(Continued)

*Primary Examiner* — Shaun R Hurley
*Assistant Examiner* — Bao-Thieu L Nguyen
(74) *Attorney, Agent, or Firm* — Alleman Hall Creasman & Tuttle LLP

(57) ABSTRACT

A shoe insole is provided which has a balance adjustability and a shock absorbability, can maintain a balance with a standard foot shape without discomfort, and improves fit and comfort by fitting to a user's foot. The insole is used by insertion into an inner bottom part of a shoe and includes a part that supports an arch of the foot, a part that recovers the balance of the foot to standard values, and a part that supports a heel of an underside of the foot, which improves stability and fit feel. A shock absorbing member is attached by pressure at least to a back side of the part that supports
(Continued)

the heel of the underside of the foot. The body part is made of a hard material, and the shock absorbing member is made of a soft material.

5 Claims, 11 Drawing Sheets

(58) Field of Classification Search
USPC ..... 36/43–44
See application file for complete search history.

(56) References Cited

U.S. PATENT DOCUMENTS 4,823,420 A 4/1989 Bartneck
5,146,698 A * 9/1992 Tilles ..... A43B 13/40 36/178
5,373,650 A 12/1994 Dananberg et al.
5,463,824 A * 11/1995 Barna ..... A43B 7/14 36/173
5,669,162 A * 9/1997 Dyer ..... A43B 7/142 36/37
6,282,816 B1 * 9/2001 Rosendahl ..... A43B 7/141 36/174
6,286,232 B1 * 9/2001 Snyder ..... A43B 7/142 36/142
6,598,319 B2 * 7/2003 Hardt ..... A43B 7/142 36/153
6,973,743 B1 * 12/2005 Mowery ..... A43B 5/001 36/127
7,107,705 B2 * 9/2006 Dalton ..... A43B 7/142 36/28
7,484,319 B2 * 2/2009 Cheskin ..... A43B 7/141 36/144
7,958,653 B2 * 6/2011 Howlett ..... A43B 7/142 36/35 R
8,800,169 B2 * 8/2014 Howlett ..... A43B 7/142 36/35 R
8,819,961 B1 * 9/2014 Ellis ..... A43B 7/1415 36/140
8,914,995 B2 * 12/2014 Andrews ..... A43B 17/003 36/140
9,003,679 B2 * 4/2015 Baucom ..... A43B 13/188 36/25 R
9,044,067 B2 * 6/2015 Edington ..... A43B 7/144
2004/0181971 A1 * 9/2004 Turkbas ..... A43B 7/141 36/44
2004/0181976 A1 * 9/2004 Copeskey ..... A43B 7/141 36/145
2006/0130366 A1 * 6/2006 Bray, Jr. ..... A43B 3/108 36/43
2007/0124959 A1 * 6/2007 Meffan ..... A43B 7/142 36/28
2008/0155858 A1 * 7/2008 Bray ..... A43B 3/108 36/91
2008/0313924 A1 * 12/2008 Righetto ..... A43B 7/144 36/28
2008/0313927 A1 * 12/2008 Conforti ..... A43B 1/0009 36/91
2009/0025254 A1 * 1/2009 Smith ..... A43B 7/141 36/44
2009/0145003 A1 * 6/2009 Kim ..... A43B 1/0009 36/44
2009/0151194 A1 * 6/2009 Cheskin ..... A43B 7/141 36/28
2009/0172972 A1 * 7/2009 Rosen ..... A43B 7/1465 36/91
2009/0183388 A1 * 7/2009 Miller ..... A43B 7/141 36/43
2010/0126044 A1 * 5/2010 Davis ..... A43B 1/0009 36/108
2013/0042502 A1 * 2/2013 Grisoni ..... A43B 7/142 36/43
2013/0133224 A1 * 5/2013 Tsai ..... A43B 3/0063 36/43
2013/0160331 A1 * 6/2013 Burke ..... A43B 1/0081 36/25 R
2013/0263470 A1 * 10/2013 Durocher ..... A43B 7/142 36/43
2013/0312279 A1 * 11/2013 Andrews ..... A43B 17/003 36/43
2014/0007456 A1 * 1/2014 Tadin ..... A43B 13/38 36/43
2014/0090274 A1 * 4/2014 Arquilla ..... A43B 1/0045 36/83
2014/0259752 A1 * 9/2014 Feldman ..... A43B 1/0081 36/43
2014/0259755 A1 * 9/2014 Tsai ..... A43B 7/1415 36/43
2014/0259757 A1 * 9/2014 Tsai ..... A43B 7/144 36/44
2015/0143713 A1 * 5/2015 Cheng ..... A43B 7/141 36/43
2015/0196090 A1 * 7/2015 Sluder, Sr. ..... A61F 13/043 36/43
2015/0305436 A1 * 10/2015 Doyle ..... A43B 17/035 36/43
2015/0342295 A1 * 12/2015 Moon ..... A43B 7/24 36/43
2016/0073730 A1 * 3/2016 Martinez ..... A43B 7/141 36/44
2016/0095382 A1 * 4/2016 Takahashi ..... A43B 17/00 36/44
2016/0128426 A1 * 5/2016 Reinhardt ..... A43B 13/04 36/44
2016/0192741 A1 * 7/2016 Mark ..... A43B 17/003 36/43
2016/0219970 A1 * 8/2016 Jacob ..... A43B 7/148

OTHER PUBLICATIONS

Japanese Patent Office, Notice of Allowance Issued in Japanese Patent Application No. 2015-025881, dated Nov. 24, 2015, 4 pages.

* cited by examiner

SHOE INSOLE

TECHNICAL FIELD

The present invention relates to a shoe insole which has both balance adjustability and shock absorbability, maintains balance with a standard foot shape, and improves fit and comfort.

BACKGROUND ART

Sponge materials excellent in cushioning are often used for the materials of a shoe insole. However, since a sponge material is inferior in flexibility, resilience, and restorability compared with a plastic material, it does not follow the motion of a foot. Therefore, it may have a problem of limiting a workout. Advantages of using a plastic material for the material of the shoe insole are that they fit to the foot, cooperatively act with ligaments and muscles, and act without limiting the movement of the foot, and thereby workouts can be performed more naturally. However, if the plastic material is too thick, since the ligaments and muscles of the foot are excessively constrained, the workout is limited. On the other hand, if the plastic material is too thin, a sufficient strength of the plastic cannot be obtained and, thus, a person cannot control his/her feet. Therefore, the present inventor uses a plastic material having flexibility, resilience, and restorability to develop a shoe insole which can instantaneously absorb and reduce an impact from any direction, and has already been granted a patent right (JP3,944,536B1: Patent Document 1).

Further, in order to improve the performance of the shoe insole, the use of both the sponge material and the plastic material together has already been considered. However, if the sponge material is used as the material of a body part of the shoe insole, and a component made of plastic material which is formed in an arch shape to support the arch of the foot is attached to the arch part underneath the body part which is a side contacting an inner bottom part of a shoe, since an impact from the ground surface is strongly transmitted to the underside of the foot through the component made of plastic material, there is a problem that the person feels pain in the foot. Therefore, the present inventor attaches a component made of plastic material to a body part of a shoe insole, which is made of a sponge material, at an arch part underside of the body part, devises the thickness, attached position, and shape of the component to develop the shoe insole which has supportability and hardly causes pain in the foot, and has already been granted a patent right (JP5,070,445B2: Patent Document 2).

REFERENCE DOCUMENTS OF CONVENTIONAL ART

Patent Documents

Patent Document 1 JP3,944,536B1
Patent Document 2 JP5,070,445B2

DISCLOSURE OF THE INVENTION

Problems to be Solved by the Invention

Since the plastic material is excellent in strength as apparent from the above-described patented inventions of the present inventor, it is ideal for maintaining a balance of one's feet and body, and if it is thin and, additionally, has bendability, resilience, and restorability, the person can perform a workout naturally without the motion of the feet being limited. Therefore, the plastic material may be ideal for the shoe insole. Furthermore, if it additionally is able to absorb shock, the plastic material is thought to be a more ideal material.

Therefore, the present inventor repeatedly performed diligent studies based on the use of the plastic material which has such an ideal performance, and as a result, the purpose of the present invention is to provide a more ideal performance to a shoe insole by devising the structure of the plastic, and to provide a shoe insole which has both a balance adjustability and a shock absorbability, can maintain a balance with a standard foot shape without discomfort, and improves fit and comfort by fitting to user's feet.

SUMMARY OF THE INVENTION

In order to address the problem described above, according to one embodiment, a shoe insole to be used by being inserted into an inner bottom part of a shoe is provided. The shoe insole includes a part of a body part of the shoe insole that supports an arch of a foot, the part having a function to maintain an ideal arched shape to recover a balance of the foot to standard values by setting the shape of the part to a foot shape having a standard height of the arch of the foot, and a part of the body part that supports a heel of an underside of the foot, the part having a function to maintain a neutral state and improve stability and fitting feel of the foot by shaping a heel back side into a horizontal surface. A shock absorbing member is attached by pressure at least to a back side of the part of the body part that supports the heel of the underside of the foot, the body part made of a hard material, the shock absorbing member made of a soft material. The part of the body part that supports the heel of the underside of the foot and the part that supports the arch of the foot are formed thicker at an inside area of a peripheral edge portion thereof to give powerful support to the foot, while the part of the body part that supports the heel of the underside of the foot and the part that supports the arch of the foot are formed thinner at the peripheral edge portion to be bent when a load is applied. The shock absorbing member is attached to the thinned parts of the peripheral edge portion of the part of the body part that supports the heel of the underside of the foot and the part that supports the arch of the foot, and an upper portion of the thinned parts.

Further, according to one embodiment, the peripheral edge portion of the part of the body part that supports the heel of the underside of the foot and the part that supports the arch of the foot may be formed thinner by providing a stepped part on a side that contacts the underside of the foot, and the shock absorbing member may be attached by pressure to the stepped part.

Further, according to one embodiment, a hole may be formed substantially at a center of the part of the body part that supports the heel of the underside of the foot, a convex portion may be formed at a position opposing the hole of the shock absorbing member, the convex portion having a shape and a thickness corresponding to the hole, and the convex portion may be fitted into the hole.

In addition, according to one embodiment, a plurality of grooves may be arranged at locations along an arc in a back side of a heel part of the shock absorbing member.

Further, according to one embodiment, in order to support a weight shift along a weight shift line of the underside of the foot at a time of walking, a plurality of ribs for supporting the arch of the foot may be formed at the back side of the part of the body part that supports the arch of the foot, and the plurality of ribs may be respectively arranged at left and right sides, extending forward from inside toward both left and right sides.

Further, according to one embodiment, the body part may be shaped to have a forward-inclining angle so that the body part conforms to the shape of the inner bottom part of the shoe when the insole is inserted into the inner bottom part having a forward-inclining angle.

Effects of the Invention

As described above, a shoe insole according to the present invention includes a part of a body part of the shoe insole that supports an arch of a foot, the part having a function to maintain an ideal arched shape to recover a balance of the foot to standard values by setting the shape of the part to a foot shape having a standard height of the arch of the foot, and a part of the body part that supports a heel of an underside of the foot, the part having a function to maintain a neutral state and improve stability and fitting feel of the foot by shaping a heel back side into a horizontal surface. Therefore, the shoe insole can fit comfortably and the ideal arch can be maintained to prevent fatigue and injury.

Further, since the body part is made of a hard material, and a shock absorbing member is made of a soft material, a balance adjustment of the foot can be performed instantaneously by the hard material, and at the same time, an impact can be absorbed by the soft material.

Further, since peripheral edge portions of the body part are thin, they are bent outward when an excessive load is applied. In addition, since the shock absorbing member is attached to portions where the peripheral edge portions of the body part are thin, and upper portions thereof, further bending is caused when the excessive load is applied. Therefore, the insole can also be suitable for a wide foot, a wide heel, a narrow foot, and a narrow heel, and can be suitable for various foot shapes. Also, since a center portion of the body part is thicker, powerful support is possible.

MODES FOR CARRYING OUT THE INVENTION

Hereinafter, one embodiment of the present invention is described with reference to the accompanying drawings. FIGS. 1 to 4 are a front elevational view (top), a rear elevational view (bottom), a right side view (outside), and a bottom view (back) illustrating one example of a shoe insole (for right foot) according to the present invention, respectively.

A part of a body part 20 of a shoe insole 10, which supports an arch of a foot, is formed in a shape having a function to recover the balance of a foot to standard values (it is set to have a standard foot shape). That is, there is an ideal foot shape for the arch of a human foot. For example, there is a suitable height of the arch of the foot for a 25 cm foot or shoe size. There is also a suitable height of the arch of the foot for a 27 cm foot size. Thus, if the foot arch heights of many people are measured, it is thought that a standard arch can naturally be derived. A shoe insole set to the standard foot shape also fits a foot comfortably. Since the shape of the shoe insole which recovers to the standard values is originally an ideal foot shape of a human being, if it can fit comfortably and the ideal arch can be maintained, the entire human body can be made neutral and fatigue and injury can be prevented.

Figure 1:
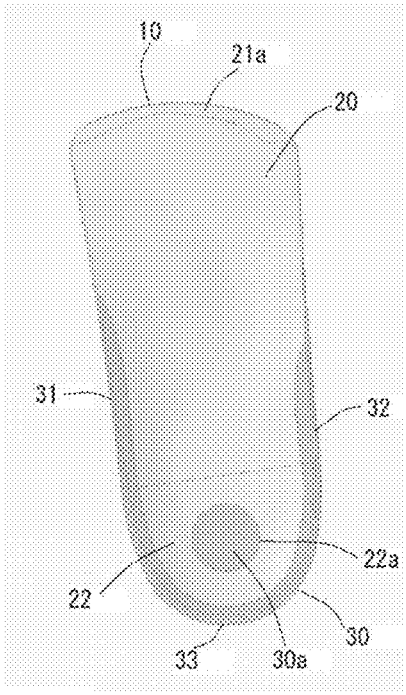
FIG. 1 is a front elevational view illustrating one example of a shoe insole (for a right foot) according to the present invention.
Figure 2:
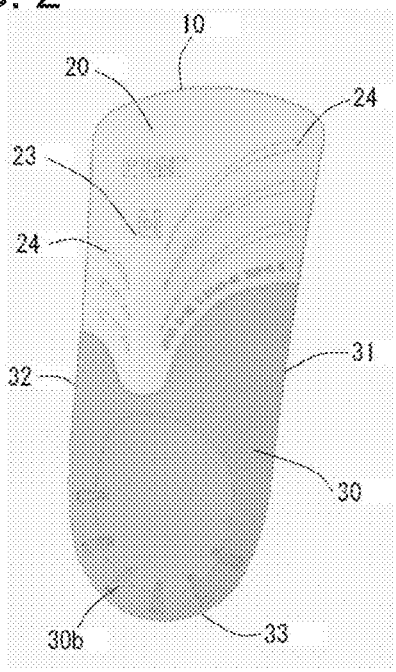
FIG. 2 is a rear elevational view of the shoe insole (for the right foot) illustrated in FIG. 1.
Figure 3:
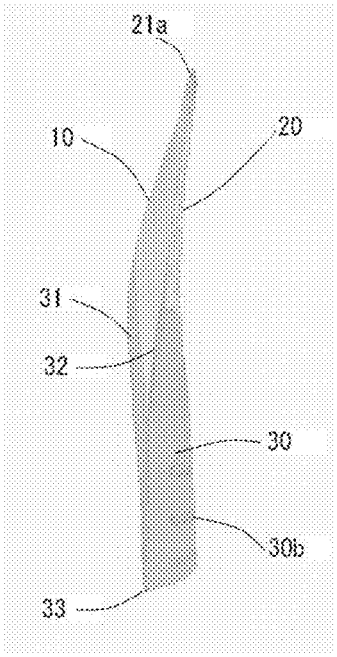
FIG. 3 is a right side view of the shoe insole (for the right foot) illustrated in FIG. 1.
Figure 4:
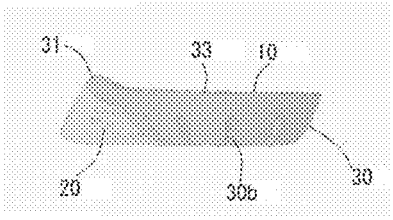
FIG. 4 is a bottom view of the shoe insole (for the right foot) illustrated in FIG. 1.

As illustrated in FIGS. 2 to 4, a shock absorbing member 30 is attached by pressure to a back side of the part of the body part 20, which supports a heel part of an underside of the foot. The body part 20 is made of hard material (plastic), and the shock absorbing member 30 is made of soft material (elastomer). Thus, since the shape of the part of the body part 20, which supports the arch of the foot, is a shape having the function to recover a balance of the foot to the standard values, it can be used comfortably even though it is made of the hard material. In addition, since the elastomer is combined with the material of the shock absorbing member 30, it is not only hard, but an impact is also absorbable.

Here, since the effect of the hard material (plastic) is instantaneously effective, a balance adjustment of the foot can be performed instantaneously. Such an adjustment of the foot balance has a good influence on the balance of the entire human body, such as the knees and waist, and can set the entire human body to a neutral position. Thereby, a burden to each joint can be reduced, fatigue can be reduced, and injury can be prevented. In the case of a hard material (plastic), even when the entire weight is applied to the shoe insole, the shoe insole is not deformed and keeps maintaining the balance of the foot and the balance of the entire human body.

Further, as to the feel when the person wears the shoe insole, since the balance adjustment is instantaneously possible for the hard material (plastic), a change to the human body can immediately be sensed. Therefore, at the moment of wearing the insole, since the change also reacts with burden-imposed parts of the entire human body and the balance is adjusted, comfort can immediately be sensed.

On the other hand, in the case of a soft material (soft sponge material, such as EVA), even if it has a shape for adjusting the foot balance, a change cannot instantaneously be made to the human body because it is soft. In addition, dents are formed after it is used for a while, and it becomes no longer possible to maintain the balance of the standard foot. Thus, the balance is lost, and a problem that discomfort and unpleasantness arise occurs.

The particular materials which constitute the shoe insole according to the present invention are described as follows. Plastic, such as polycarbonate, ABS resin, polypropylene, polo ethylene, and nylon, is adopted for the hard material of the body part 20. In addition, if the hardness is to be increased, fibers, such as glass fibers or carbon, are blended. Nylon is a material with high resilience. According to the resilience of nylon, a thrust can be created and, thus, the person can smoothly walk and play sports, and weight can easily be shifted. Elastomer (hardness: 40 to 70) is used for the soft material of the shock absorbing member 30. The purpose of use may be altered by changing the resilience and hardness. For example, when nylon and glass fibers are blended with the hard material of the body part 20, it is suitable for sports because the resilience increases. However, in the case of nylon alone, it is suitable for everyday life, etc., because it becomes somewhat soft.

Figure 5:
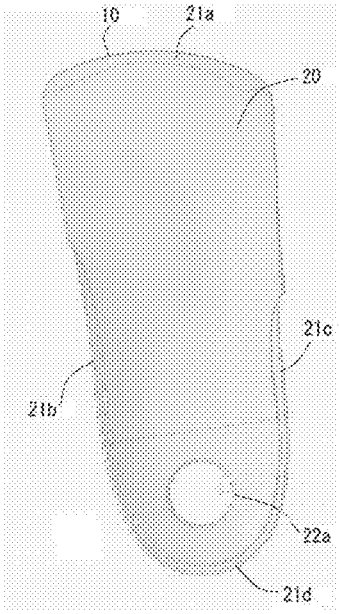
FIG. 5 is a front elevational view of a body part of the shoe insole (for the right foot) illustrated in FIG. 1.
Figure 6:
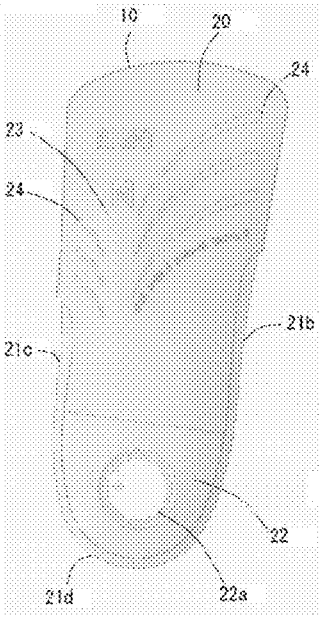
FIG. 6 is a rear elevational view of the body part of the shoe insole (for the right foot) illustrated in FIG. 1.
Figure 7:
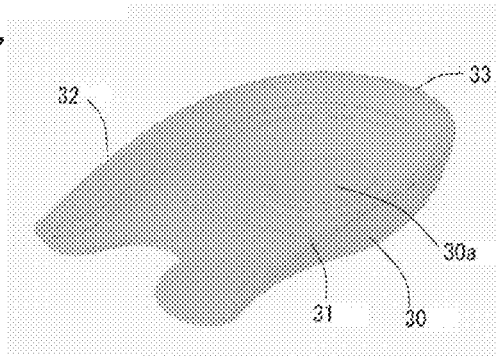
FIG. 7 is a perspective view of a shock absorbing member of the shoe insole (for the right foot) illustrated in FIG. 1.
Figure 8:
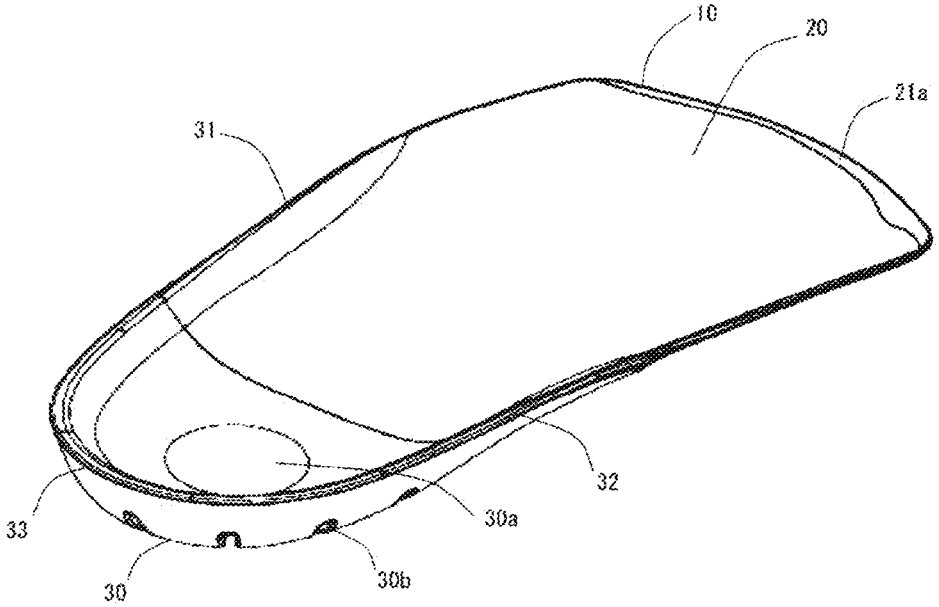
FIG. 8 is a perspective view of the shoe insole (for the right foot) illustrated in FIG. 1.
Figure 9:
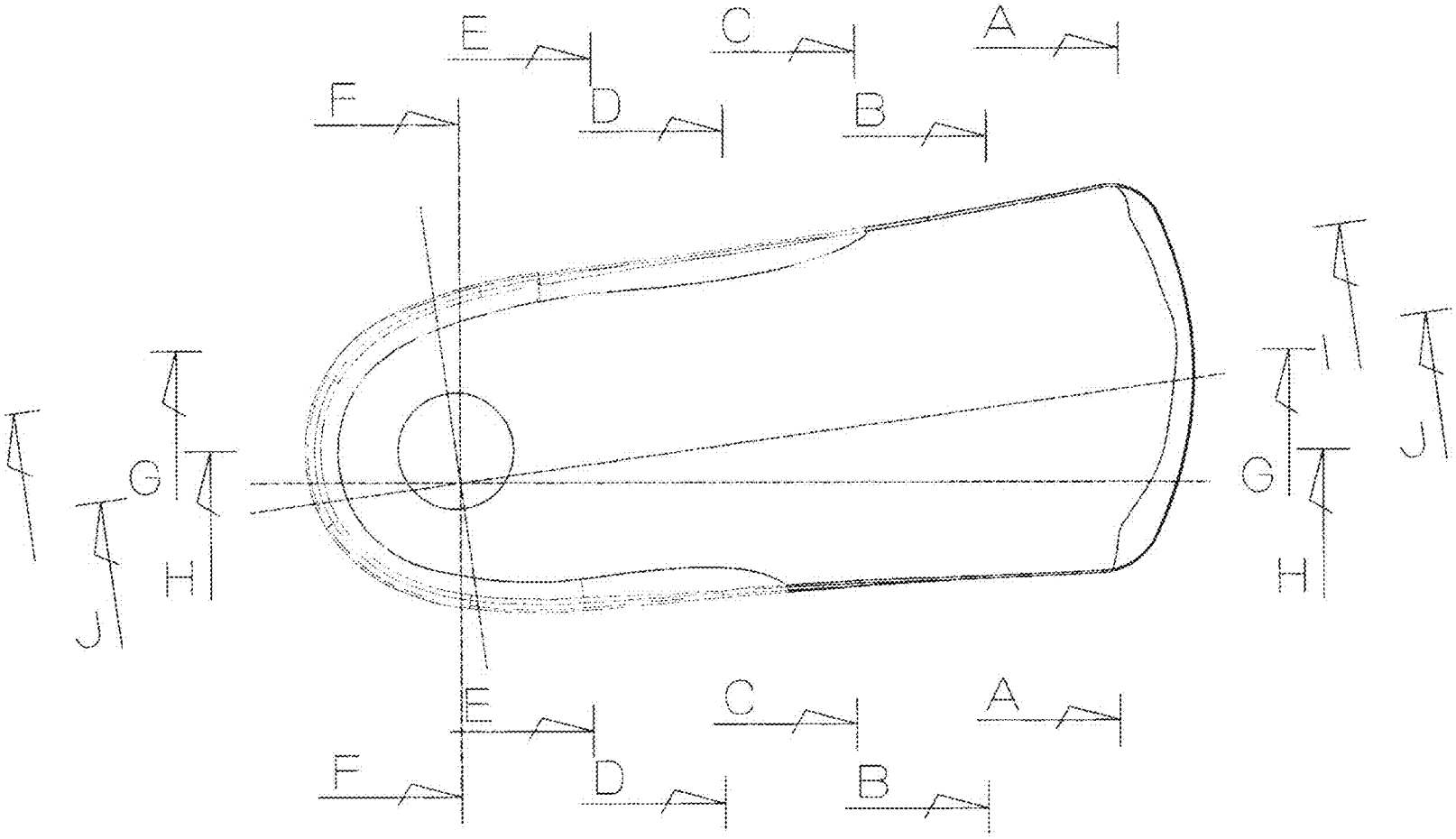
FIG. 9 is a diagram illustrating cross-sectional positions in the front elevational view of FIG. 1.
Figure 10:
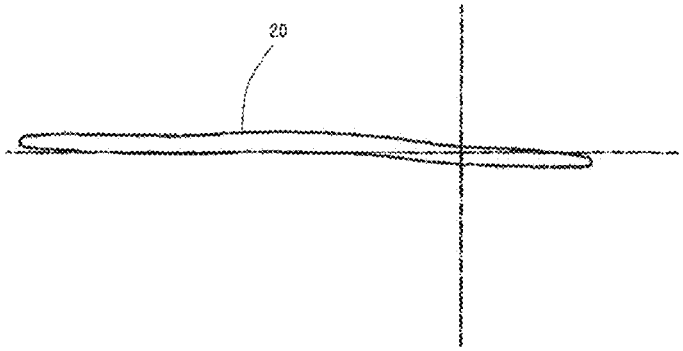
FIG. 10 is a cross-sectional view taken along a line A-A of FIG. 9.
Figure 11:
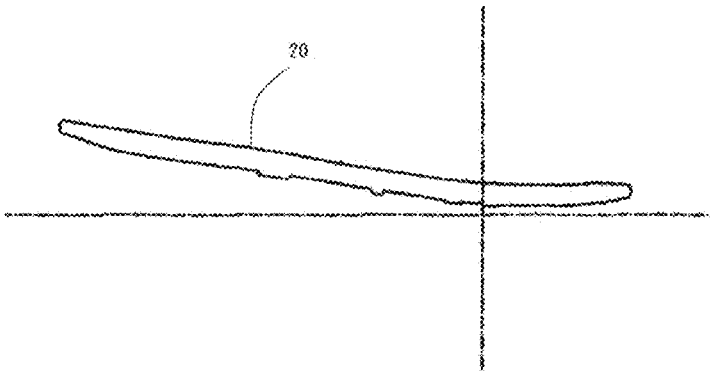
FIG. 11 is a cross-sectional view taken along a line B-B of FIG. 9.
Figure 12:
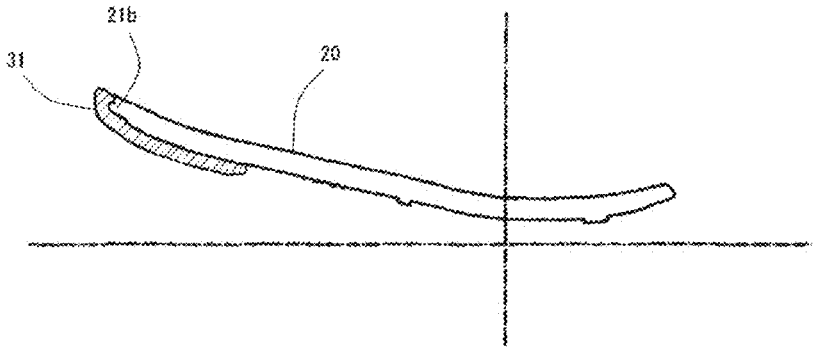
FIG. 12 is a cross-sectional view taken along a line C-C of FIG. 9.
Figure 13:
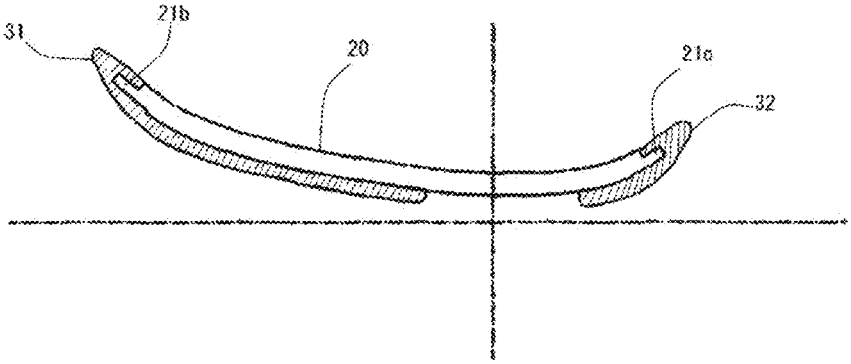
FIG. 13 is a cross-sectional view taken along a line D-D of FIG. 9.
Figure 14:
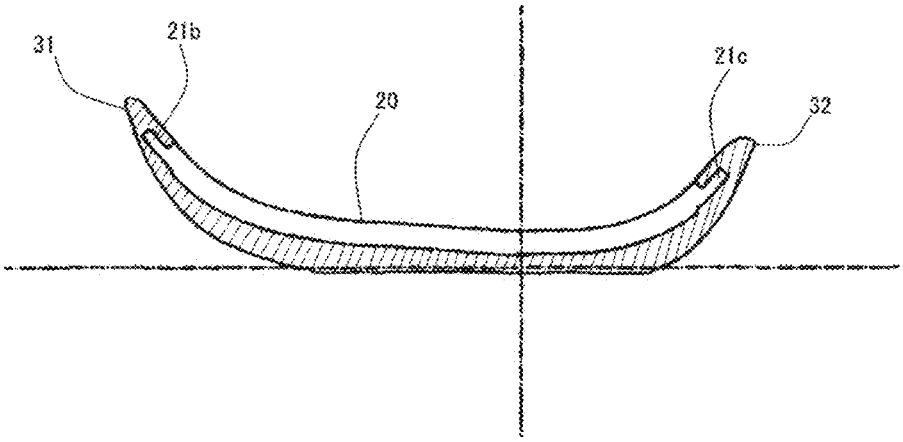
FIG. 14 is a cross-sectional view taken along a line E-E of FIG. 9.

As illustrated in FIGS. 5 and 6, a hole 22*a* is formed at substantially a center of a heel part 22 of the body part 20. As illustrated in FIG. 7, at a position which opposes to the hole 22*a* of the shock absorbing member 30, a convex portion 30*a* having the shape and thickness corresponding to the hole 22*a* is formed so as to protrude so that the convex portion 30*a* is fitted in the hole 22*a* (refer to FIG. 8). Thus, the part of the body part 20, which supports the heel of the underside of the foot can have increased shock absorbability.

Figure 15:
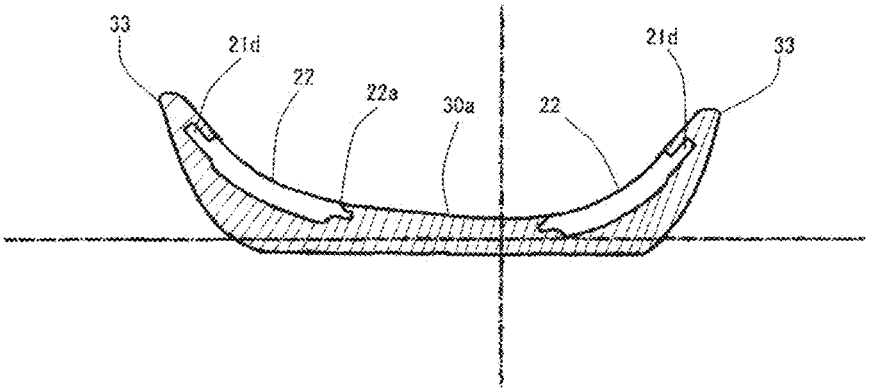
FIG. 15 is a cross-sectional view taken along a line F-F of FIG. 9.
Figure 16:
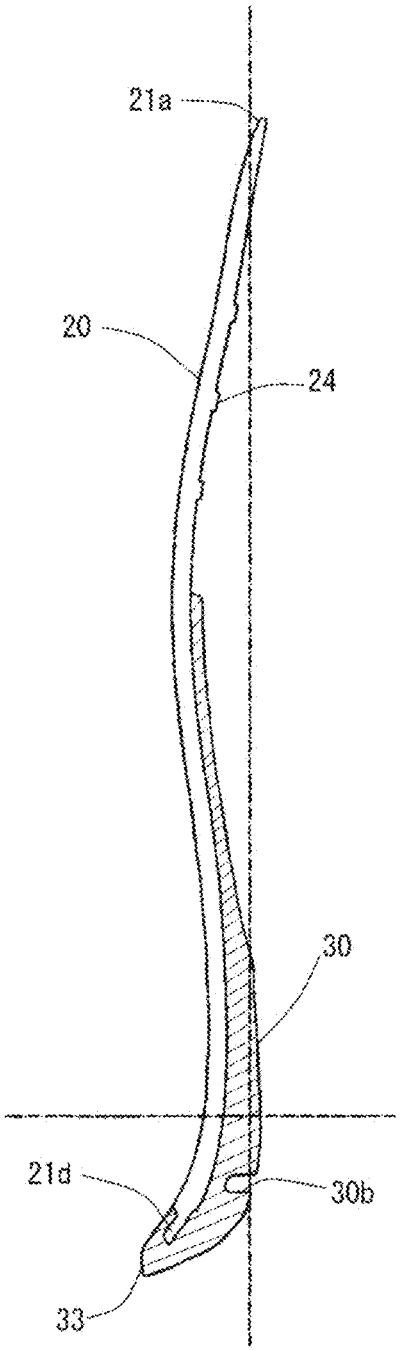
FIG. 16 is a cross-sectional view taken along a line G-G of FIG. 9.
Figure 17:
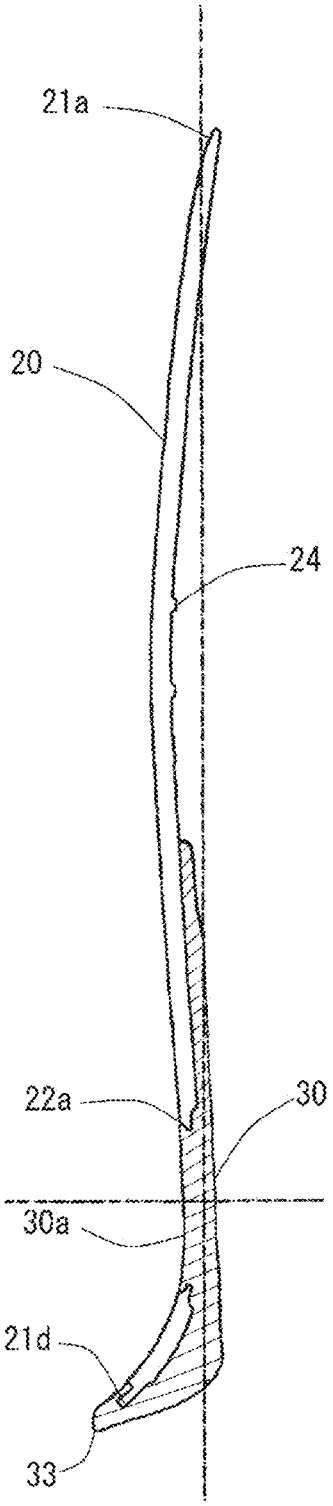
FIG. 17 is a cross-sectional view taken along a line H-H of FIG. 9.
Figure 18:
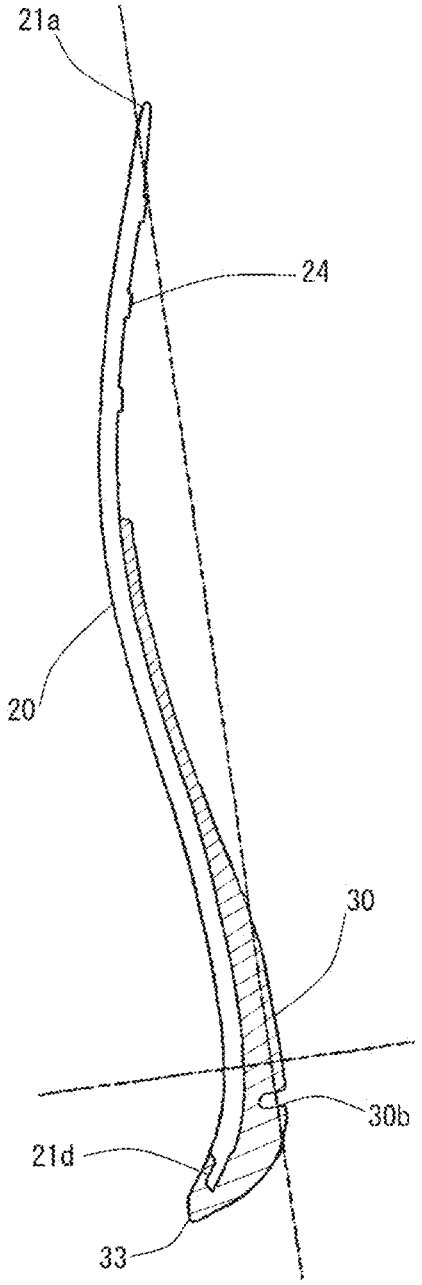
FIG. 18 is a cross-sectional view taken along a line I-I of FIG. 9.
Figure 19:
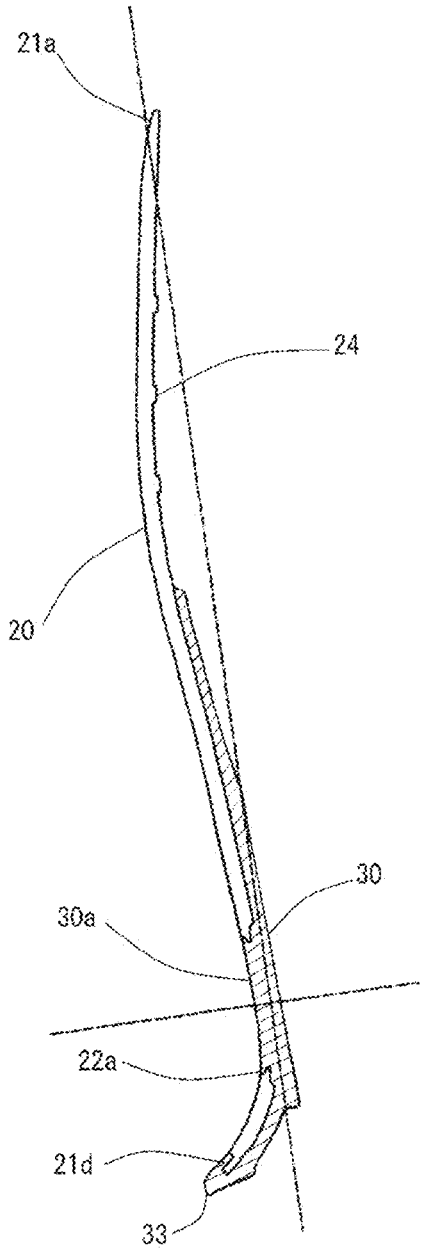
FIG. 19 is a cross-sectional view taken along a line J-J of FIG. 9.

As illustrated in FIGS. 15 and 17, by forming the back side of the heel part into a horizontal surface, the part of the body part 20, which supports the heel of the underside of the foot, is always maintained in a neutral state, and thereby it increases stability of the person's heel and is excellent in applicability to a flatfoot.

As illustrated in FIGS. 5 and 6, the body part 20 is formed so that thicknesses of peripheral edge portions 21*a*, 21*b*, 21*c*, and 21*d* of the body part 20 are made thin (about 0.5 mm to 2 mm) so as to be bent when a load is applied, and it is formed so that thickness of an inside area may be made into thickness (about 2 mm to 4 mm) from the peripheral edge portions 21*a*, 21*b*, 21*c*, and 21*d* of the body part 20 and powerful support can be given. As illustrated in FIGS. 12 to 19, shock absorbing members (inside 31, outside 32, heel side 33) are attached to peripheral edge portions 21*b*, 21*c*, and 21*d* of the body part 20 and upper portions thereof, respectively.

Thus, since the peripheral edge portions 21*a*, 21*b*, 21*c*, and 21*d* of the body part 20 are thin, they are bent outward when an excessive load is applied. In addition, since the shock absorbing members (inside 31, outside 32, heel side 33) are attached to the portions where the peripheral edge portions 21*b*, 21*c*, and 21*d* of the body part are thin, and the upper portions thereof, the bending is further caused when the excessive load is applied. Therefore, the insole is also suitable for a wide foot, a wide heel, a narrow foot, and a narrow heel, and is suitable for various foot shapes. As for the structure of the heel part 22, as illustrated in FIGS. 15 and 17, by making the peripheral edge portion 21*d* thinner, the insole can correspond to the heel width due to the bendability, while by making an inside area from the peripheral edge portion 21*d* thicker, the person's weight can be supported and a powerful support can be given. As described above, by making the perimeter thinner, the stability and fitting feel of the foot can be improved, a "backlash" for stimulating the movement is provided to correspond to the foot width, especially the heel width or size. Further, since elastomer is attached by pressure to the thinner portions, a breakage can be prevented and the bendability can be maintained. Since the center portion of the body part 20 is thicker, powerful support is possible. In the case of a custom-made insole in which an insole is created for each individual, since the insole is created in consideration of a foot shape of each individual, there is no trouble even if the entire insole is made of hard material. However, in the case of a ready-made insole, since the insole has to fit to the foot shape of anybody, it is structured to fit to anybody's foot by combining "hard part," "soft part," and "bendability."

In the example of the shoe insole (for right foot) according to the present invention, one example in which the shock absorbing member 30 is attached by pressure to the back side of the heel part 22 of the body part 20, and the shock absorbing members (inside 31, outside 32, heel side 33) are attached to the peripheral edge portions 21*b*, 21*c*, and 21*d* of the body part 20 and the upper portions thereof is described. However, the present invention is not limited to the illustrated structure, and the shock absorbing member 30 may be attached by pressure at least to the back side of the heel part 22 of the body part 20. Further, as for the process to attach the shock absorbing member 30 to the body part 20 by pressure, mass producibility and an improvement in quality may be achieved by integrally forming the shock absorbing member 30 and the body part 20, for example, by using a double-injection molding method.

As illustrated in FIGS. 2 to 4, a plurality of grooves 30*b* are disposed at locations along an arc on the back side of the heel part of the shock absorbing member 30. Thereby, when a load is applied, the effect of absorbing an impact at the heel part can be improved. Note that the quantity and shape of the grooves 30*b* are not limited to the illustrated structure but may suitably be formed corresponding to, for example, the hardness of the shock absorbing member 30.

As illustrated in FIGS. 2 and 6, a plurality of arch support ribs 24 which support a weight shift along a weight shift line of the underside of the feet while the person walks are formed on the back side of the arched part 23 of the body part 20 which supports the arch of the foot. Thus, the ribs are formed at locations where the support is necessary to increase the strength. The ribs are varied in height according to the locations so that necessary strength is given at locations where the foot needs to be supported. Further, the center portion is also varied in thickness according to the locations so that necessary thickness is given at locations where the foot needs to be supported.

Figure 20:
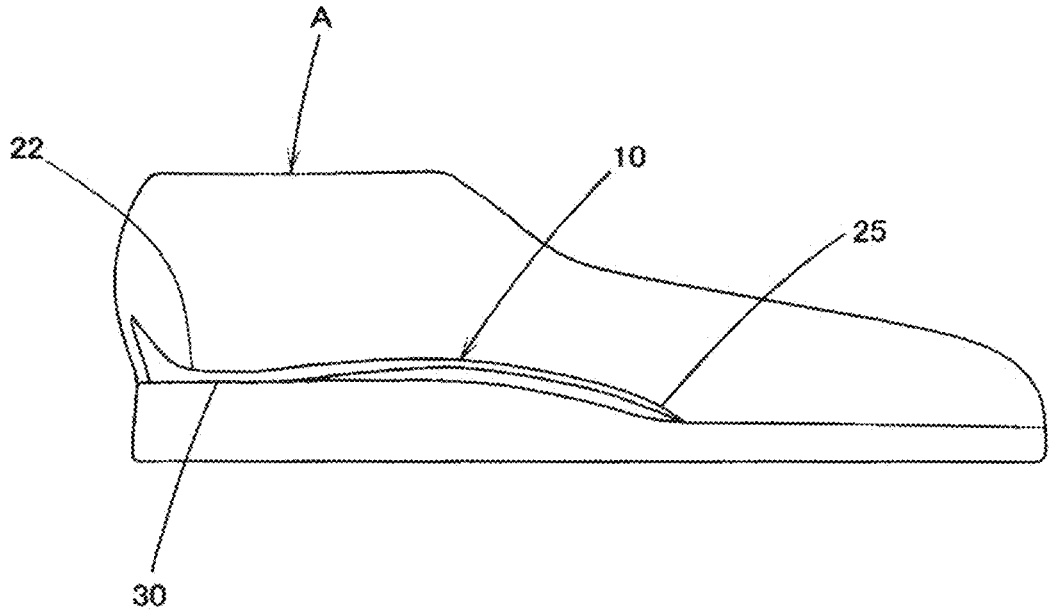
FIG. 20 is a view illustrating a state where the shoe insole according to the present invention is inserted into an inner bottom part of a shoe.

As illustrated in FIGS. 16 to 20, the body part is shaped to have a forward-inclining angle so that it conforms to the shape of an inner bottom part having a forward-inclining angle when inserted into the inner bottom part of a shoe. Thereby, as illustrated in FIG. 20, the shoe insole 10 has the shape so that the heel becomes stable because the back side horizontal surface (shock absorbing member 30) of the heel part 22 of the shoe insole 10 contacts an upper surface of the inner bottom part of a shoe A, while the insole becomes stabilized in the shoe because the insole conforms to the forward-inclining angle of the inner bottom part of the shoe A, when the insole is inserted into the inner bottom part of the shoe to use. Thus, discomfort to the foot is decreased because the foot, the shoe insole 10, and the shoe A move integrally without the shoe insole 10 moving around inside the shoe A. Further, when the insole is attached to the shoe and the person actually wears the shoe, the effect of the shape which has the function to recover the arched shape of the underside of the foot is maintained.

As described above, depending on how it is used, the shoe insole according to the present invention can outperform custom-made insoles as demonstrated due to the use of the ribs, thickness adjustments, and stable manufacturing technique. The insole has the effect of improved performance because of the arrangement of the thicknesses, the ribs, etc., with consideration to the shifting of weight of the underside of the foot.

LIST OF REFERENCE CHARACTERS

A Shoe
10 Shoe Insole
20 Body Part
21 Peripheral Edge Portion
22 Heel Part
22*a* Hole
23 Arched Part
24 Rib
25 Tip-end Part
30 Shock Absorbing Member
30*a* Convex Portion
30*b* Groove
31 Inside
32 Outside
33 Heel Side

The invention claimed is:

1. A shoe insole to be used by being inserted into an inner bottom part of a shoe, comprising:

a first part of a body part of the shoe insole configured to support an arch of a foot; and a second part of the body part configured to support a heel of an underside of the foot, the second part configured to shape a heel back side into a horizontal surface, wherein a shock absorbing member is attached by pressure at least to a back side of the second part, the shock absorbing member made of a soft material that is an elastomer, and the body part made of a hard material harder than the soft material, wherein the second part and the first part are formed thicker at an inside area of a peripheral edge portion thereof to give support to the foot, while the second part and the first part are formed thinner at the peripheral edge portion to be bent when a load is applied, and wherein the shock absorbing member is integrally formed with an upper portion of the thinned parts of the peripheral edge portion of the second part and the first part by a double-injection molding method, wherein a plurality of ribs for supporting the arch of the foot are formed on the back side of the first part to thereby support a weight shift along a weight shift line of the underside of the foot at a time of walking, and the plurality of ribs are respectively arranged at left and right sides, extending forward from inside toward both left and right sides.

2. The shoe insole according to claim 1, wherein the peripheral edge portion of the second part and the first part are formed thinner by providing a stepped part on a side that contacts the underside of the foot, and the shock absorbing member is attached by pressure to the stepped part.

3. The shoe insole according to claim 1, wherein a hole is formed substantially at a center of the second part, a convex portion is formed at a position opposing the hole of the shock absorbing member, the convex portion having a shape and a thickness corresponding to the hole, and the convex portion being fitted into the hole.

4. The shoe insole according to claim 1, wherein a plurality of grooves are arranged at locations along an arc on a back side of a heel part of the shock absorbing member.

5. The shoe insole according to claim 1, wherein the body part is shaped to have a forward-inclining angle so that the body part conforms to the shape of the inner bottom part of the shoe when the insole is inserted into the inner bottom part having a forward-inclining angle.

* * * * *